United States Patent [19]

Terrell

[11] 4,256,228

[45] Mar. 17, 1981

[54] APPARATUS FOR REMOVING ROVING OR THE LIKE FROM TEXTILE BOBBINS OR THE LIKE

[75] Inventor: Robert E. Terrell, Charlotte, N.C.

[73] Assignee: The Terrell Machine Company, Charlotte, N.C.

[21] Appl. No.: 900,761

[22] Filed: Apr. 27, 1978

[51] Int. Cl.[2] ..... B07C 5/00

[52] U.S. Cl. ..... 209/600; 209/927

[58] Field of Search ..... 209/927, 600

[56] References Cited

U.S. PATENT DOCUMENTS

| | | | |
|---|---|---|---|
| 2,868,372 | 1/1959 | Ferguson | 209/600 |
| 3,049,231 | 8/1962 | Crandall et al. | 209/600 |
| 3,305,087 | 2/1967 | Lücker | 209/927 |
| 3,387,703 | 6/1968 | Foster | 209/927 |

*Primary Examiner*—Allen N. Knowles

*Attorney, Agent, or Firm*—Richard, Shefte & Pinckney

[57] ABSTRACT

The apparatus has two pairs of long driven nip rolls on which bobbins with residual roving are advanced axially in a row with the nip rolls engaging the ends of residual roving and unwinding the roving into a delivery plenum therebelow through which the roving is drawn by suction to the surface of a rotating perforated delivery drum through which the suction is drawn to retain the roving thereon as the drum rotates the roving to a discharge plenum in which a shredding drum shreds the roving for discharge in pieces through a discharge plenum. A perforated baffle plate is mounted closely adjacent the delivery drum to confine suction through the drum and to allow suction to be drawn through the plate into the drum. The perforated baffle plate extends adjacent the shredding drum to confine the roving thereto and for suction to be drawn therethrough to direct the roving to the shredding drum. The bobbins advance from the rolls onto a support on which a feeler finger extends at an inclination toward the bobbins to sense residual roving on bobbins. An arm acts in response to the sensing to remove the bobbin with the sensed roving from the line. The feeler finger is deactivated when the leading end of a bobbin passes the finger in response to the trailing end of a bobbin dropping into a downwardly offset section of the support spaced a bobbin length from the finger.

10 Claims, 13 Drawing Figures

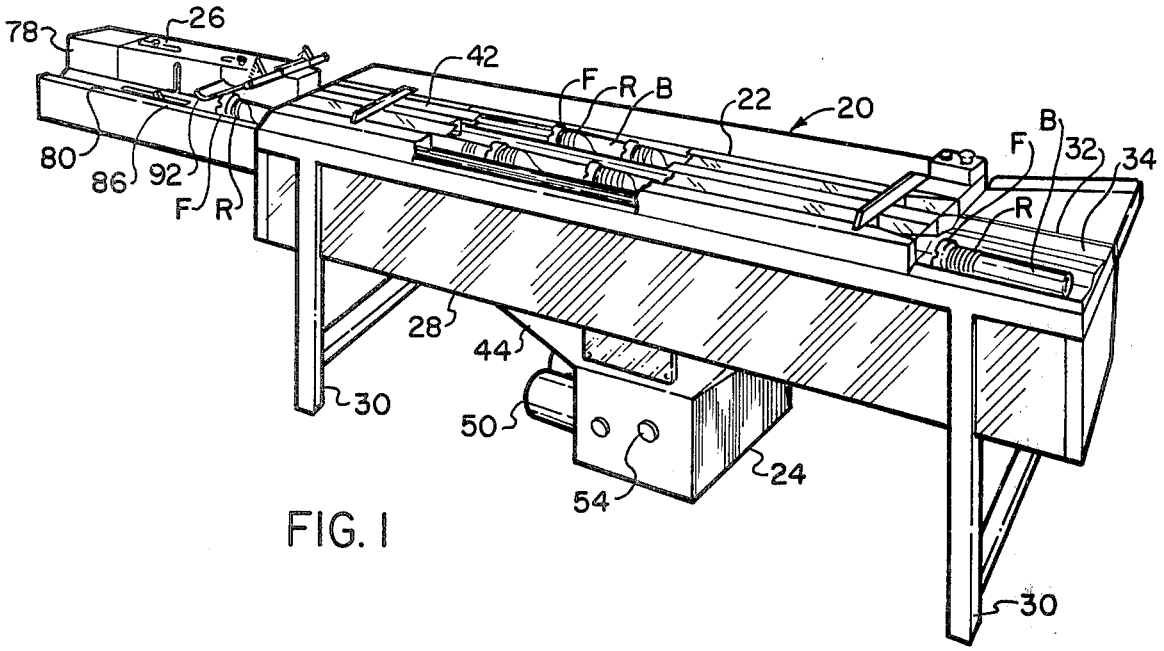
FIG. 1
FIG. 2
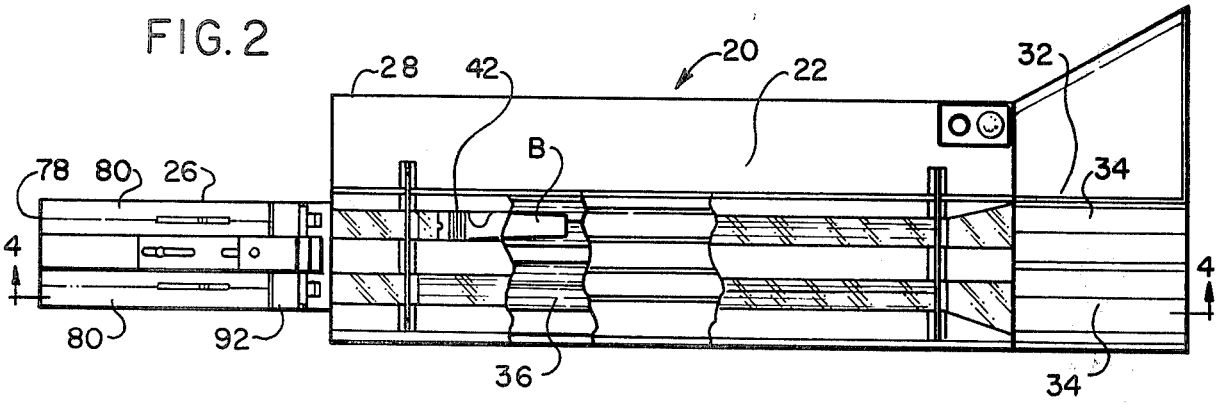
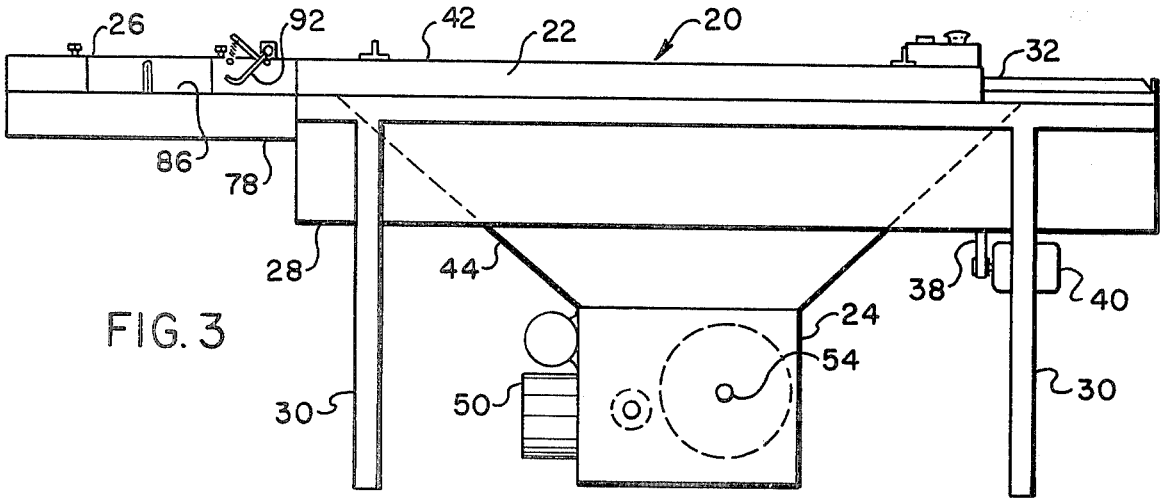
FIG. 3

APPARATUS FOR REMOVING ROVING OR THE LIKE FROM TEXTILE BOBBINS OR THE LIKE

BACKGROUND OF THE INVENTION

This invention relates in general to an apparatus for removing wound material from a carrier core and for removing cores with unremoved material from a row of cores. More particularly, the present invention relates to the removal of residual or waste roving from bobbins from which roving packages have been unwound in textile spinning operations and that must have the waste roving cleared therefrom before they can be reused satisfactorily to receive a new roving supply package for delivery again to a spinning operation, and to the removal from a row of cleaned bobbins any bobbins with waste roving inadvertently remaining thereon following the roving removal operation.

A typical prior art roving removal apparatus of this general type is disclosed in Gwaltney et al U.S. Pat. No. 3,163,913 issued Jan. 5, 1965, which discloses a pair of nip rolls along which bobbins are advanced in a row and rotated for engagement of the ends of residual roving on the bobbins in the roll nip, which unwinds the roving and feeds it onto a conveyor belt for transport to a pair of back rolls from which the roving feeds to a pair of drafting rolls that provides a loosening or opening draft on the roving. The bobbins advance from the nip rolls onto a chute along which they slide into a collection cart or box. This apparatus has proven commercially effective, but it requires a driven conveyor and pairs of back and drafting rolls, and the necessary spacing between the nip of the back rolls and the nip of the drafting rolls results in a short length at the end of the roving being released by the back rolls without drafting between the back and drafting rolls. Also, this apparatus has no device for removing from the row of bobbins advancing from the apparatus those bobbins that have inadvertently not been completely cleaned of roving with the result that some uncleaned bobbins will be recycled, causing problems in the spinning operation.

SUMMARY OF THE PRESENT INVENTION

The present invention is an improvement of the apparatus of the Gwaltney U.S. Pat. No. 3,163,913 as it provides a simplified arrangement for shredding the unwound roving and importantly does so in a manner that effectively shreds substantially the entire length of unwound roving, including the trailing end. Further, the present invention includes a simple and reliable device for sensing and removing bobbins that pass through the apparatus with some residual moving remaining thereon so that only clean bobbins will be allowed to advance for recycling.

Briefly described, the apparatus for shredding textile roving or the like into short pieces according to the present invention includes a housing formed with a delivery plenum into and through which a strand of roving may be drawn by suction and a discharge plenum through and from which shredded pieces of roving may be drawn by suction. A hollow perforated delivery drum is mounted for rotation in the housing between the plenums and is disposed for drawing of suction through the surface thereof at the delivery plenum interiorly across the drum and outwardly through the surface thereof at the discharge plenum. Means are provided for rotating the drum to transport roving received thereon at the delivery plenum and retained thereon by suction to the discharge plenum for discharge of the roving therefrom by the suction drawn through the drum and the discharge plenum. Baffle means is disposed between the plenums and closely adjacent the exterior surface of the drum for confining the drawing of suction primarily through the drum while allowing roving to be transported on the drum between the drum and baffle means. Means is located in the discharge plenum adjacent the drum for shredding the roving delivered thereto by the drum and suction, with the suction in the discharge plenum discharging the shredded roving therefrom.

Preferably, the baffle means is a plate disposed adjacent the drum and extending therealong to define a passage for roving transported on the drum from the delivery plenum to the discharge plenum and the shredding means is disposed adjacent the baffle means for shredding engagement of the roving as it enters the discharge plenum from the passage between the baffle means and the delivery drum.

In the preferred embodiment, the plate of the baffle means is perforated for drawing of suction therethrough into the drum to facilitate retention of the roving on the drum between the drum and baffle means and to resist drawing of suction between the drum and baffle means from the delivery plenum. Also, the shredding means is a shredding drum and the plate of the baffle means extends adjacent the shredding drum and is perforated for drawing of suction therethrough into the discharge plenum to direct the roving toward the shredding means. The baffle means plate is arcuately curved adjacent the delivery drum and arcuately curved adjacent the shredding drum with the angle therebetween being acute and past which the roving advances to the shredding drum.

The shredding apparatus of the present invention may be combined with nip rolls mounted on the housing at the delivery plenum for engaging the end of a strand of residual roving on a bobbin rotating on the rolls to unwind the roving from the bobbin and feed it into the delivery plenum for drawing by suction to the delivery drum. This arrangement can be combined in the present invention with an apparatus for selectively removing bobbins that has residual roving thereon from a row of bobbins advancing from the nip rolls.

This apparatus for selectively removing bobbins according to the present invention includes means for supporting advancing bobbins and means for sensing bobbins supported on the supporting means with residual roving remaining thereon. Means responsive to the sensing means is provided for selectively removing sensed bobbins from the supporting means while allowing other bobbins to pass along the supporting means. The bobbin supporting means has an offset section with the initial portion thereof spaced from the sensing means one or a multiple bobbin length and disposed to be out of bobbin contact as a bobbin advances into the offset section while being contacted by the trailing end of a bobbin upon lateral movement thereof as it enters the initial portion of the offset section. Further, means is provided in the initial portion of the offset section responsive to a bobbin trailing end in the initial portion of the offset section for temporarily deactivating the sensing means to allow a bobbin leading end to pass the sensing means without activation thereof.

Preferably, the sensing means is a feeler finger projecting into the path of advancing bobbins at an inclination toward the bobbins as they advance to the feeler finger, with the finger being forced farther into the bobbin path by engagement of residual yarn on a bobbin with a corresponding displacement of the engaged bobbin until the feeler finger movement is sufficient for response by the bobbin removing means.

In the preferred embodiment, the bobbin supporting means extends under the row of bobbins and the offset section is offset downwardly for downwardly inclined advance of bobbins thereto and dropping of bobbin trailing ends into the initial portion thereof. The responsive means in the initial offset portion is a movable member disposed for movable engagement by a bobbin trailing end and is connected to a rocker arm that rocks in response to movement thereof and is connected to the feeler finger to pivot the finger out of the bobbin path upon rocking of the arm. To facilitate the action of the bobbin trailing end on the movable member, guiding means in the form of a pivoted and weighted member is disposed above the offset section for weightingly resting on a bobbin advancing therepast.

BRIEF DESCRIPTION OF THE DRAWINGS

FIG. 1 is a perspective view of an apparatus for removing roving from textile bobbins according to the preferred embodiment of the present invention;

FIG. 2 is a plan view, partially broken away, of the apparatus of FIG. 1;

FIG. 3 is an elevation view of the apparatus of FIG. 1;

DESCRIPTION OF THE PREFERRED EMBODIMENTS

Figure 4:
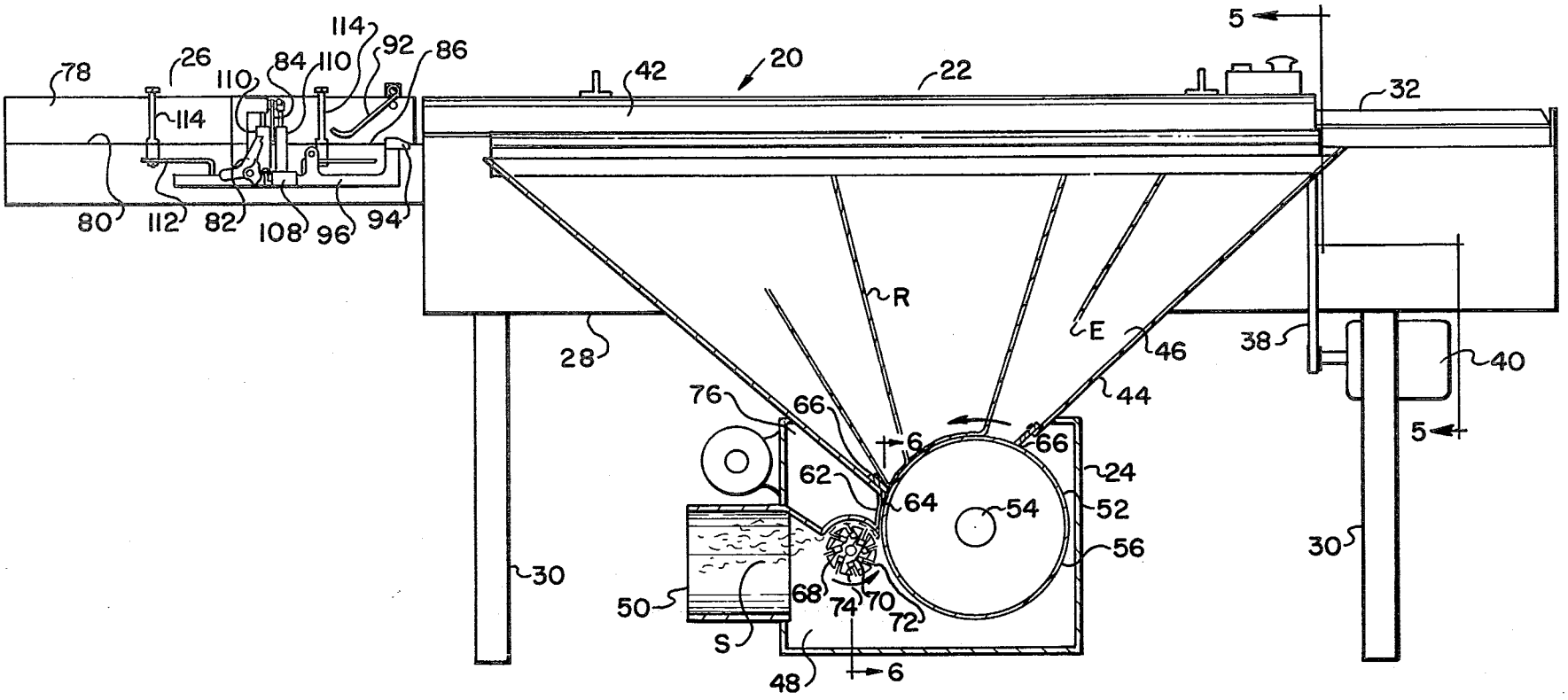
FIG. 4 is an enlarged vertical section view taken along line 4—4 of FIG. 2.
Figure 5:
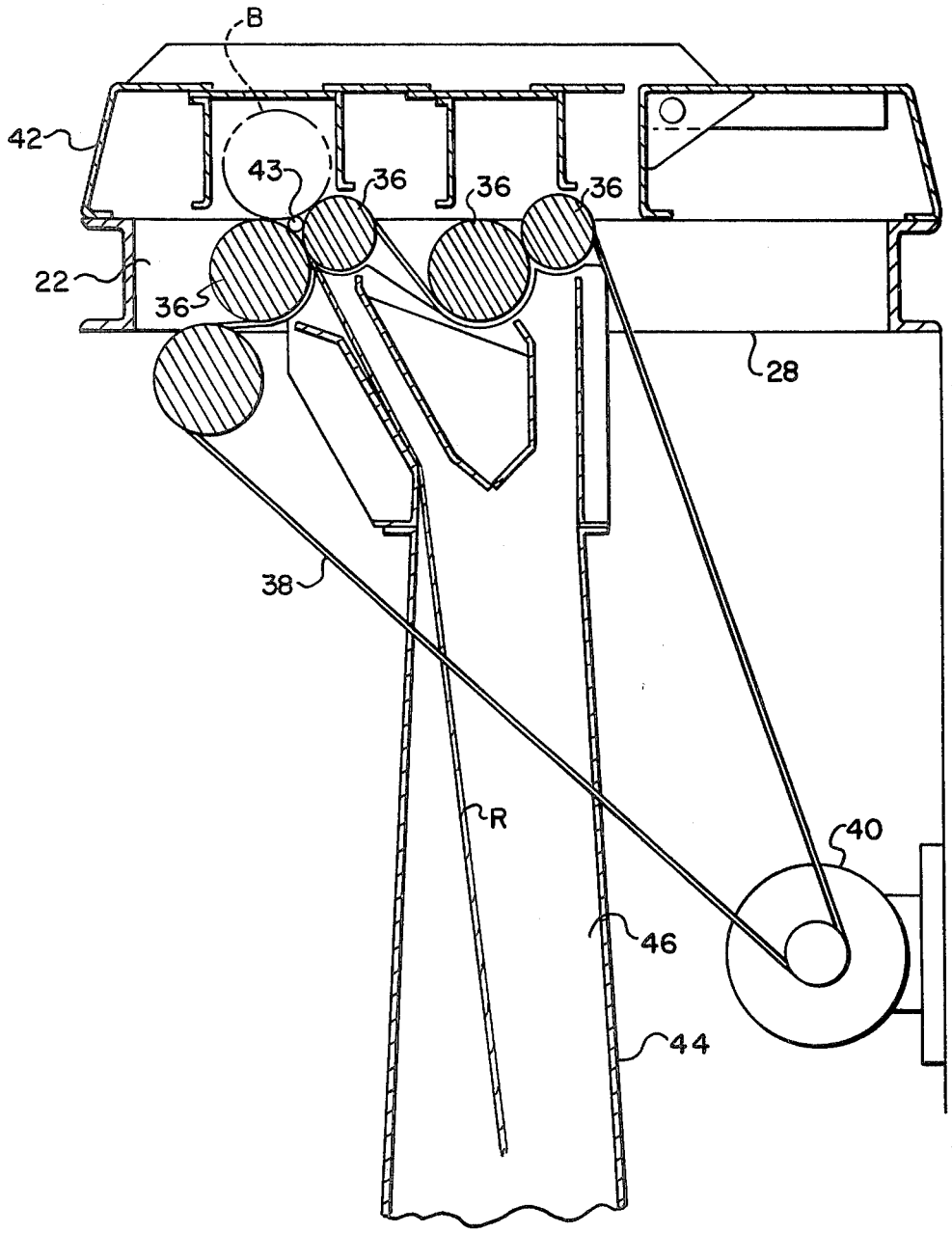
FIG. 5 is an enlarged vertical sectional view taken along line 5—5 of FIG. 4 showing the apparatus for unwinding roving from a bobbin.
Figure 6:
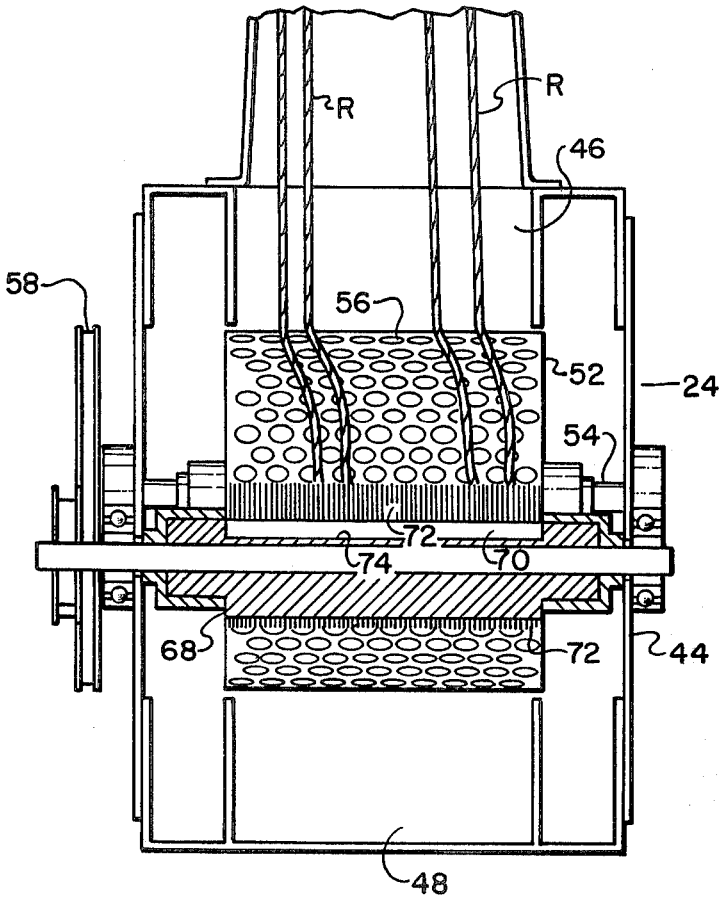
FIG. 6 is an enlarged vertical sectional view taken along line 6—6 of FIG. 4 showing the apparatus for shredding roving.
Figure 7:
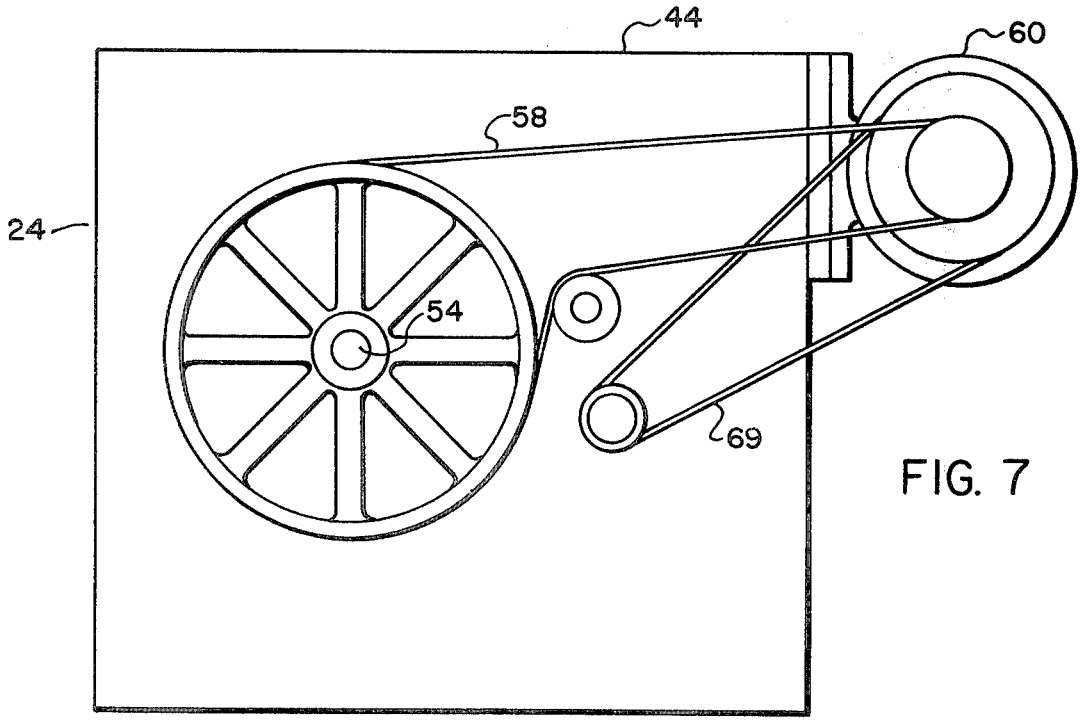
FIG. 7 is an enlarged elevational view of the shredding apparatus of FIG. 6 as viewed from the left of FIG. 6.

Referring to the drawings, the preferred embodiment of the present invention is shown incorporated in a machine 20 for removing roving R from textile bobbins B for recycling of the bobbins in a textile spinning operation. The machine 20 combines apparatus 22 for unwinding roving R from the bobbins B, apparatus for shredding the roving R into short pieces S, and apparatus for removing bobbins having residual roving thereon following the unwinding operation.

All of the components of the machine of the preferred embodiment are mounted on a main frame 28 supported on legs 30. Bobbins B are advanced through the machine 20 manually from a feeding platform 32 at the right (FIG. 1) of the machine. This platform 32 is provided with a pair of parallel troughs 34 in which bobbins B are placed and pushed along by the operator to form two rows of bobbins that are advanced through the machine by the operator pushing bobbins against the end of the row at the feeding platform 32. These troughs 34 are aligned with two pairs of horizontally extending nip rolls that are driven through a belt drive 38 from an electric motor 40. The bobbins B are retained in position on the nip rolls 36 and protected by a cover 42 that is pivoted on the main frame 28 for positioning in either a bobbin covering disposition during operation of the machine or in a raised position to allow access to the bobbins.

The nip rolls 36 of each pair rotate in opposite directions and one roll of each pair is covered with a friction material to impart rotation to the bobbins supported thereon. The rotation of the bobbins B causes the extending ends E of roving thereon to project outwardly by centrifugal force and be engaged in the nip of the rolls, the rotation of which causes the roving ends E to be engaged and pulled downwardly in a roving unwinding direction as the bobbins B continue to be rotated. A small free rolling rod 43 is supported on the rolls to facilitate the positioning of the bobbins for rotation and to form a nip close to the bobbins to facilitate engagement of the roving in the nip of the rolls 36.

The aforementioned shredding apparatus 24 is mounted on the main frame 28 directly below the nip rolls 36. This shredding apparatus 24 is supported in a housing 44 supported from and depending below the main frame 28. The housing 44 is formed with a delivery plenum 46 that is open under the full length of the nip rolls 36 and tapers downwardly to a discharge plenum 48 therebelow from which shredded roving pieces S are discharged.

Suction is imposed by any conventional means at the discharge end 50 of the discharge plenum 48 to draw suction down through the delivery plenum 46 and through the discharge plenum 48 to the discharge end 50 thereof, thereby drawing roving R being unwound from the bobbins B by the nip rolls 36 through the shredding apparatus 24 for shredding and discharge as shredded pieces S.

A hollow perforated delivery drum 52 is mounted for rotation in the housing 44 between the delivery plenum 46 and discharge plenum 48 on an axial shaft 54 disposed horizontally and transversely with respect to the axis of the nip rolls 36. The suction drawn through the delivery plenum 46 and discharge plenum 48 is drawn through the perforated surface 56 of the delivery drum 52 at the delivery plenum 46, interiorly across the drum 52 and outwardly through the surface 56 thereof at the discharge plenum 48. The drum 52 is rotated counterclockwise (FIGS. 3 and 4) by a belt drive 58 connected to the shaft 54 from a drive motor 60 mounted on the housing 44.

With this plenum, drum and suction arrangement, roving is drawn by suction onto the surface 56 of the drum 52 and carried thereon by rotation of the drum to the discharge plenum at which the suction draws the roving from the drum surface 56. To confine the drawing of suction primarily through the drum rather than around the outside of the drum, baffle means in the form of a plate 62 is disposed between the plenums and closely adjacent the exterior surface 56 of the delivery drum 52. This baffle plate 62 extends across the housing 44 and provides only a small passage 64 between the drum and plate sufficient only to allow roving R on the drum surface 56 to pass therethrough from the delivery plenum 46 to the discharge plenum 48. The confining of suction to pass through the delivery drum 52 is further facilitated by adjustable end plates 66 mounted on the bottons of the transverse walls of the delivery plenum 46 at the delivery drum 52.

Means is disposed in the discharge plenum 48 adjacent the delivery drum 52 for shredding roving delivered thereto by the drum and suction. In the illustrated embodiment, the shredding means is in the form of a shredding drum 68 mounted across the discharge plenum 48 for rotation about a horizontal axis transverse to the axis of the nip rolls and parallel to the axis of the delivery drum 52, with rotation provided by a belt drive 69 from the motor 60. The shredding drum 68 carries a plurality of combs 70 of shredding teeth in longitudinal grooves 74 recessed in the surface of the shredding drum 68. The shredding drum 68 is disposed close to the delivery drum 52 so that the teeth 72 will engage roving as it leaves the delivery drum surface 56, and the shredding drum 68 is rotated by the aforementioned belt drive 58 and drive motor 60 at a surface speed substantially faster than that of the delivery drum so that the shredding drum teeth 72 have a loosening, opening, and shredding action on the roving to shred it into small pieces S.

The aforementioned baffle plate 62 is curved arcuately in conformance with the curvature of the delivery drum 52 to define the aforementioned passage 64 and is perforated along the delivery drum 52 for drawing of suction through an auxiliary plenum formed in the housing 44 behind the baffle plate 62 and communicating with the atmosphere. In this manner, suction is drawn through the auxiliary plenum 76, perforated baffle plate 62, across the passage 64 and through the interior of the perforated delivery drum 52. This auxiliary suction facilitates retention of the roving R on the delivery drum 52 as it passes through the passage 64 on the drum, and the auxiliary suction also forms a barrier to resist the drawing of suction through the passage 64 from the delivery plenum 46 to the discharge plenum 48.

The baffle plate 62 extends from adjacent the delivery drum 52 into the discharge plenum 48 closely adjacent the toothed surface of the shredding drum 68 to confine the roving R closely to the shredding drum 68 as the roving leaves the delivery drum 52, thereby assuring proper positioning of the roving R for effective shredding. The baffle plate 62 extends across the discharge plenum 48 and is curved arcuately in general conformance with the surface of the shredding drum 68, with the aforementioned curvature adjacent the delivery drum 52 and the curvature adjacent the shredding drum 68 forming an acute angle therebetween, around which angle the roving R passes from the delivery drum 52 to the shredding drum 68 to facilitate the shredding action and to facilitate retention of the roving R on the delivery drum 52 closely adjacent the shredding drum 68 to provide as short a space as possible therebetween for shredding of the roving into short pieces S. This baffle plate and the suction through the interior of the delivery drum 52 holds the roving back as the shredding drum 68 pulls short pieces therefrom and this action continues down to the last short end of the roving for effective shredding of the entire length of roving, which could not be done effectively with prior art devices.

The baffle plate 62 is also perforated adjacent the shredding drum 68 for drawing suction therethrough into the discharge plenum 48 to direct the roving R toward the shredding drum 68 to facilitate effective shredding action by the shredding drum 68, which shredding drum rotates counterclockwise (FIGS. 3 and 4) to act reversely on the roving R being delivered by the deliverly drum 52, which also rotates counterclockwise, and to pull the roving in a shredding action against the baffle plate at the aforementioned acute angle formed therein.

The aforementioned bobbin removing apparatus 26 extends longitudinally from the nip rolls 36 and is mounted on a framework 78 projecting from the main frame 28 at the left in FIGS. 3 and 4. This bobbin removing apparatus 26 includes means aligned with the nip rolls 36 for supporting bobbins advancing from the rolls. In the preferred embodiment the bobbin supporting means is in the form of a pair of spaced parallel troughs 80 aligned with the nip rolls 36 and extending initially on the same horizontal level as the nip rolls. Means in the form of feeler fingers 82 are disposed for sensing bobbins supported in the troughs 80 having residual roving remaining thereon, wherein bobbins need to be removed from the row of advancing cleaned bobbins so as not to be recycled without further cleaning. For this purpose, means in the form of kicker arms 84 are pivotally disposed adjacent the trough 80 and are responsive to sensing by the feeler fingers 82 for selectively removing sensed bobbins while allowing other bobbins to pass along the supporting means troughs 80. The supporting means has offset sections 86, which are offset downwardly in the illustrated embodiment from ledges 88 that are spaced in the direction of bobbin advance from the nip rolls 36 and between the nip rolls and the feeler fingers 82. The offset sections 86 have initial portions 90 adjacent the ledges 88 and spaced generally one bobbin length from the feeler fingers. Alternatively, the spacing could be a multiple of the bobbin length. The purpose of the spacing is to have the trailing end of a bobbin at the initial offset portion 90 when the leading end of the bobbin or the leading end of another bobbin is passing the position of the feeler finger 82 for a purpose to be described. The initial offset portion 90 is disposed to be out of bobbin contact as a bobbin advances into the offset section 86 over the ledge 88 while being contacted by the trailing end of a bobbin upon lateral movement thereof as it enters the initial offset portion 90. Thus, as a bobbin advances along a bobbin supporting means trough 80 it will first pass over the ledge 88 and then incline downwardly onto the offset portion 86 making contact therewith beyond the initial offset portion 90, and when the trailing end of the bobbin passes over the ledge 88 it will drop directly into the initial offset portion 90. To assure proper dropping of the trailing end of the bobbin B into the initial offset portion 90, guide means is yieldably mounted transversely opposite the initial offset portion, and in the preferred embodiment the guide means is in the form of weighted members 92 pivotally hinged to the framework 26 across and above the initial offset portion 90 for weightingly resting on bobbins advancing therepast. To enhance the effectiveness of the weighted members coil springs 93 are attached to upstanding studs 91 and to the framework 26 to bias the members into bobbin engagement.

Disposed in the initial offset portions 90 is means responsive to the presence of a bobbin trailing end in the initial offset portion for temporarily deactivating the sensing means feeler fingers 82 to allow a bobbin leading end to pass the feeler fingers without activation thereof. In the illustrated preferred embodiment, the means responsive to a bobbin trailing end is a block 94 in the bottom of each initial offset portion 90 for receiving bobbin trailing ends and to be downwardly displaced by a dropping bobbin trailing end. This downward displacement is provided by the blocks being mounted on longitudinally extending rocker arms 96 that are suspended from pivot arms 98 that are pivoted at cross pivots 100 supported on the framework 78 between the blocks 94 and the feeler fingers 82.

Figure 8:
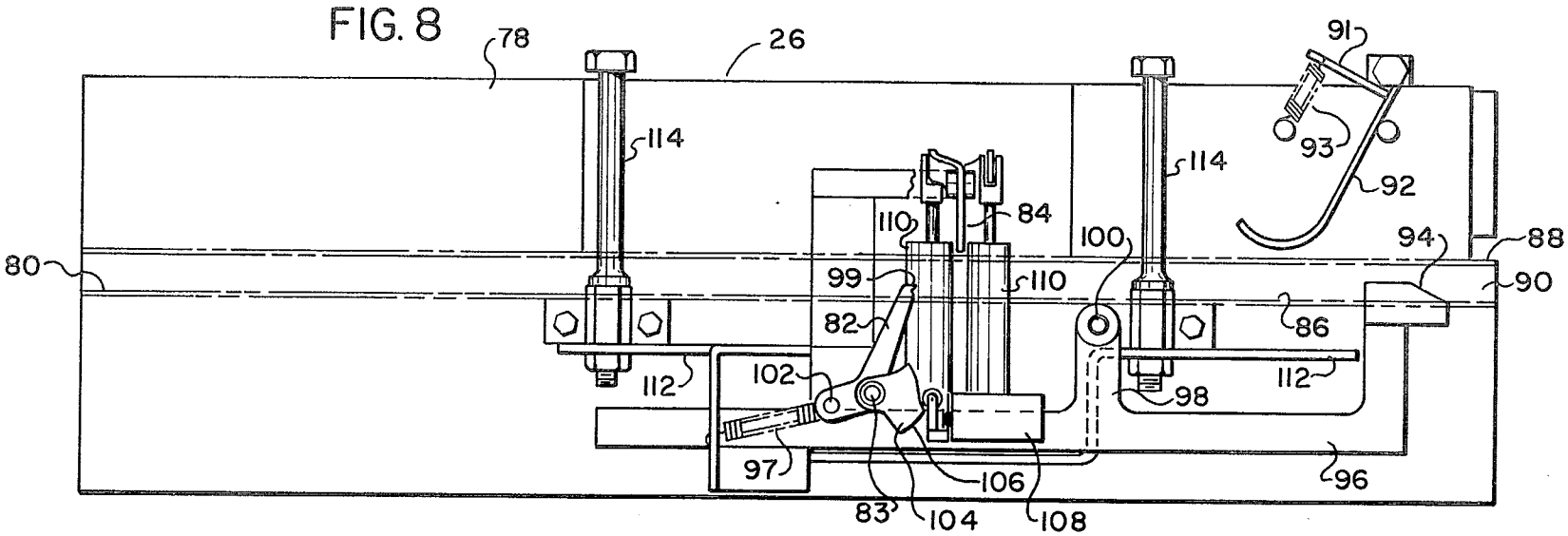
FIG. 8 is an enlarged elevational view of the bobbin removing apparatus shown with the paneling removed.
Figure 9:
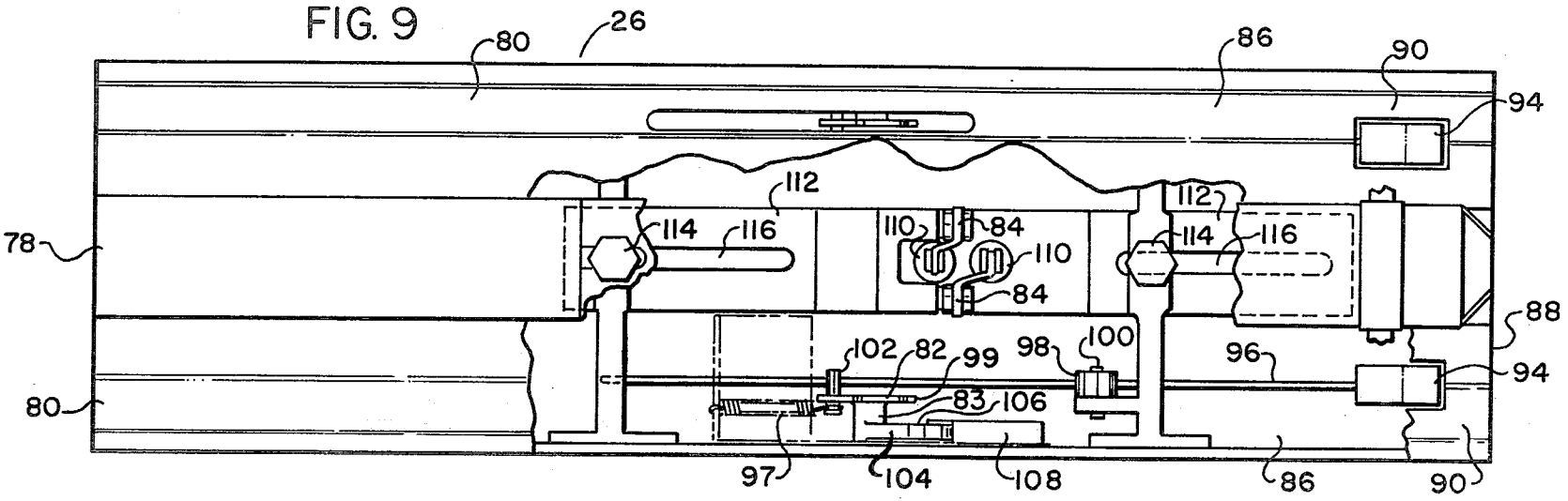
FIG. 9 is a plan view of the apparatus of FIG. 8, partially broken away.
Figure 10:
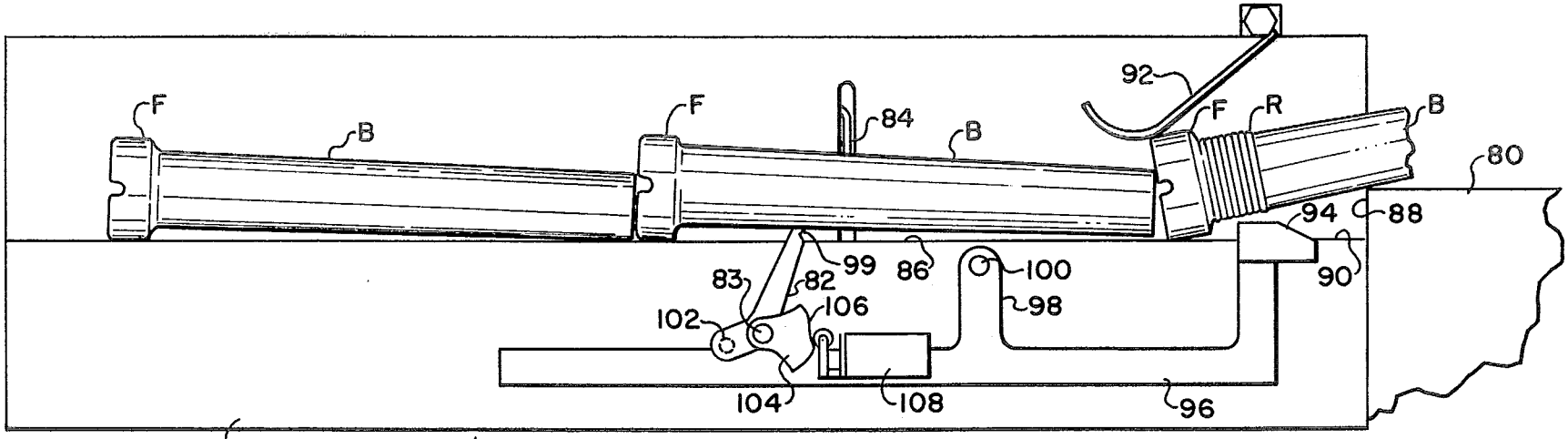
FIGS. 10, 11 and 12 are schematic illustrations of the sequential operation of the bobbin removing apparatus.
Figure 11:
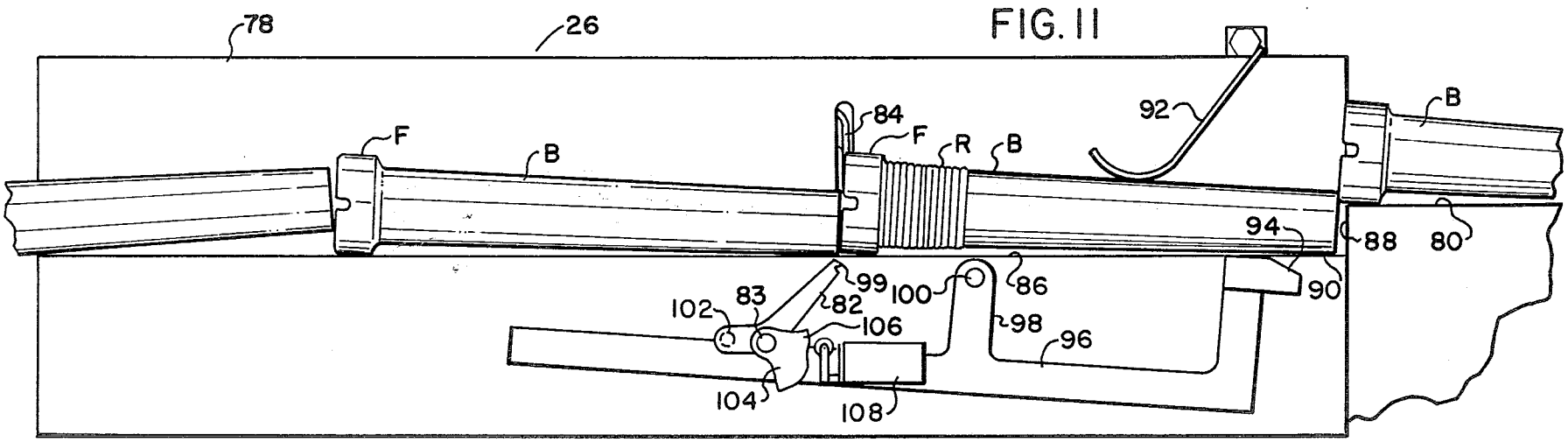
Figure 12:
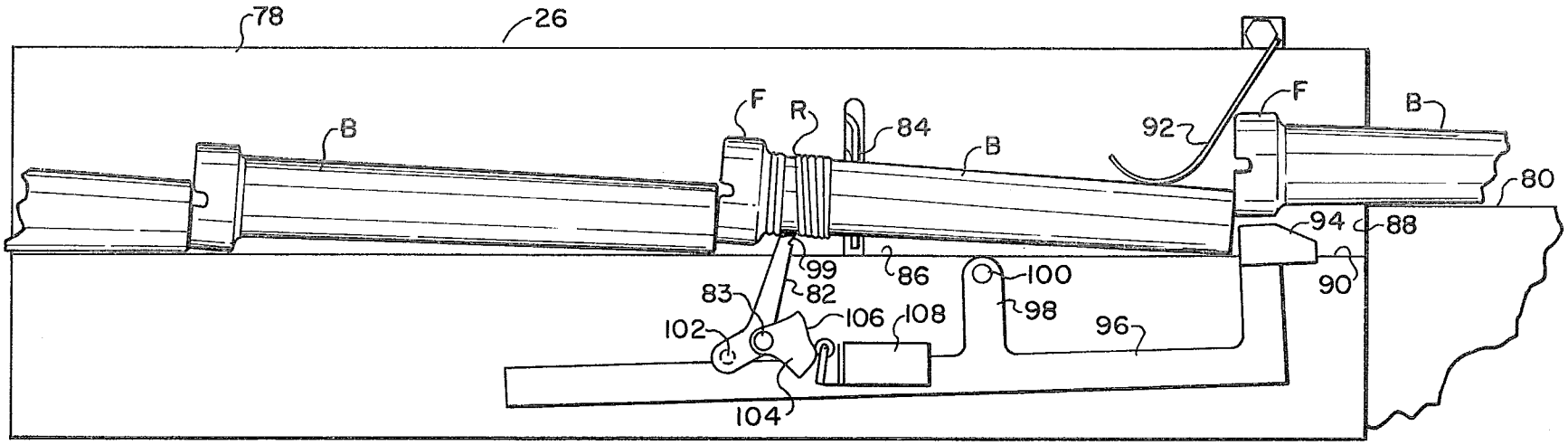
Figure 13:
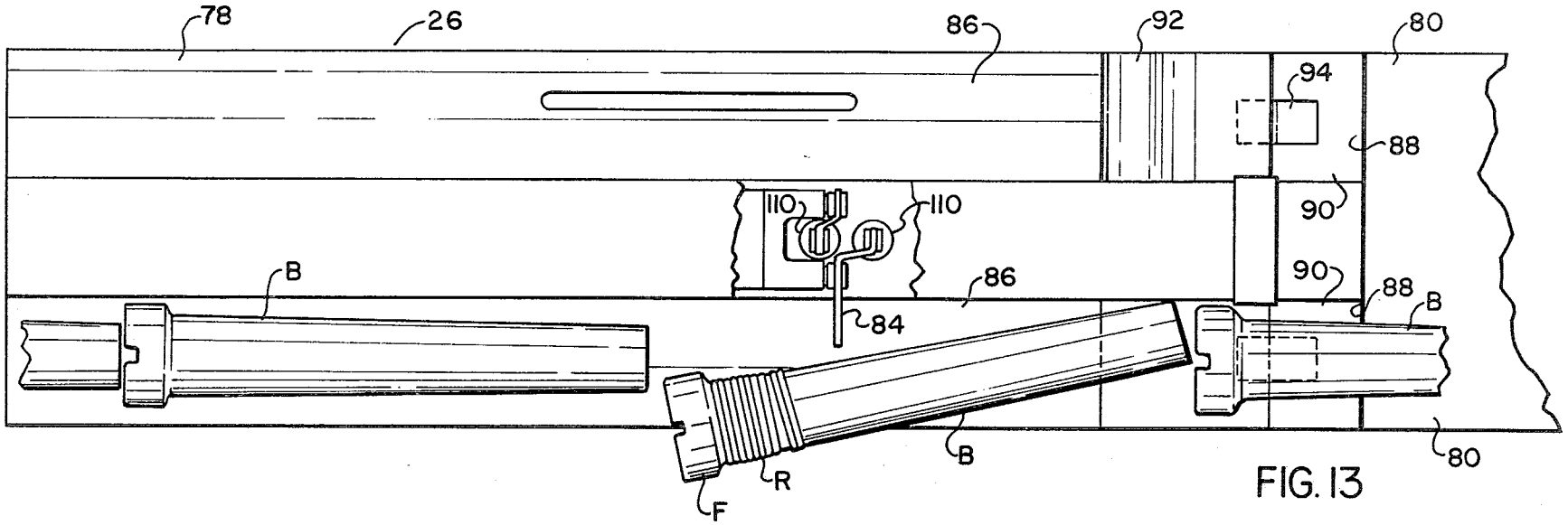
FIG. 13 is a schematic plan view of the bobbin removing apparatus showing a bobbin in the process of being removed.

The rocker arms 96 rearwardly of the framework 78 for engagement of laterally projecting pins 102 carried by the feeler fingers 82 rearwardly of the pivot posts 83 on which the fingers pivot. Also fixed to the fingers 82 on the same pivot posts 83 are cam discs 104. The fingers 82 are biased upwardly by downwardly biasing of the pins 102 against the rocker arms 96 through the action of coil springs 97 connected to the pins 102 and to the framework 78 rearwardly and downwardly therefrom. The rocker arms 96 snd pins 102 are arranged so that downward movement of the bobbin trailing end responsive blocks 94 will cause rocking of the rocker arms 96 upwardly and, through engagement with the pins 102, a pivoting of the cam discs 104 in a clockwise direction (FIG. 8). The rocker arms 96 and cam discs 104 are located below the offset sections 86 of the bobbin supporting troughs 80 and the feeler fingers 82 project through the troughs 80 into the path of advancing bobbins at an inclination toward the bobbins as they advance toward the feeler fingers, i.e. the feeler fingers are inclined to the right in FIGS. 4 and 9–12). With this arrangement the feeler fingers 82 are in position for engagement of the surfaces of the bobbins B for sensing irregularities, particularly the presence of residual yarn on the bobbin, which residual yarn is engaged by projecting tips 99 at the ends of the feeler fingers 82, with further advancement of the bobbins causing the fingers to be forced farther into the bobbin path by counterclockwise rotation thereof, which can cause upward displacement of the engaged bobbins. This allows an appreciable pivoting of the feeler fingers 82 to that fine sensitivity of the mechanism is not necessary and substantial movement can be obtained to activate the sensing mechansim, which is in the form of cam surfaces 106 formed on the cam discs 104 for operation of switches 108 upon pivoting of the feeler fingers 82 and discs 104, and with the switches 108 controlling air valves 110 that operate the aforementioned kicker arms 84 mounted in advance of the feeler fingers 82 in the framework 78 alongside the level of the bobbins on the offset sections 86 of the bobbin supporting troughs 80. The kicker arms 84 are pivoted along axes parallel to the bobbins for movement of the kicker arms 84 against the sides of the bobbins to remove the bobbins laterally from the troughs 80 when the kicker arms 84 are activated. The inactive position of the kicker arms 84 is in the framework 78 out of the path of the bobbins. The cam discs 104 are shaped to allow pivoting of the feeler fingers 82 downwardly by upward rocker arm engagement without switch actuation so that the fingers can be pivoted out of action when a bobbin end passes without actuating the kicker arms 84.

In operation, bobbins B to be cleaned are advanced manually along the feeding platform 32 in a row that progresses along the nip rolls at which the ends E of roving R on the bobbins are captured in the roll nips, which unwind the roving R from the bobbins B and feed it through the shredding apparatus 24 as described herein above. The bobbins then progress onto the bobbin supporting troughs 80 of the bobbin removing apparatus 26, and as they cross the ledges 88 they begin to incline downwardly onto the offset sections 86, with the bobbin trailing ends dropping off the ledges onto the initial offset portions 90 that are out of contact with the bobbins until the trailing ends drop thereonto. This dropping causes the blocks 94 to be displaced downwardly and rock the arms 96 to cause pivoting of the feeler fingers 82 out of the path of advancing bobbins. Because of the bobbin length spacing of the fingers 82 from the initial offset portion 90, the feeler fingers are pivoted out of bobbin contact as the leading end of a bobbin passes a feeler finger 82 and, therefore, the feeler finger will not engage the end face of the leading end of a bobbin and obstruct passage of the bobbin or provide a sensing indication. As the bobbin trailing end leaves the initial offset portion 90, the rocker arm, which is weighted oppositely of the block 94, will raise the block and will return the feeler finger 82 into sensing position in the path of and in engagement with the side surface of the advancing bobbin. Any residual yarn on the bobbin will be engaged by the feeler finger 82, which will pivot upwardly due to this engagement upon further advancement of the bobbin, with the upward movement causing a corresponding displacement of the engaged bobbin until the feeler finger movement is sufficient to cause a switch closing response by corresponding rotation of the cam discs 104, which thereupon effects actuation of the kicker arm 84 to remove the bobbin laterally from the trough 80.

Bobbins B that have been cleaned of roving and, therefore, do not have residual roving thereon to be engaged by the feeler fingers 82, advance along the bobbin supporting troughs 80 past the feeler fingers 82 for discharge from the ends of the troughs 80 into suitable containers or onto a conveyor for transport to equipment at which the bobbins are again wound with roving for subsequent presentation at spinning machines. Those bobbins that had residual roving thereon and which were removed from the row of bobbins by the kicker arms 84 may be run through the present apparatus again for further cleaning or the residual roving may be removed manually and the bobbin replaced in the cycle.

The bobbins B are fed to the machine with the ends with the flanges F being the leading ends. In this way the flanges F will pass the feeler fingers 82 when they are deactivated. Should a bobbin be inadvertently fed with the flange F trailing, the feeler finger 82 will engage the flange and be pivoted thereby to activate the kicker arm 84 and thereby remove the bobbin even if it has no residual roving thereon. Thus, an occasional wrongly-placed clean bobbin may be removed with unclean bobbins, but this is no problem as the only disadvantage is an occasional reprocessing of a clean bobbin.

Adjustment of the bobbin removing apparatus 26 to accommodate bobbins of different lengths is accomplished by the mounting of the components thereof on a platform 112 mounted on the framework 78 through stud 114 and slot 116 connections that permit longitudinal shifting.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. Apparatus for selectively removing bobbins or the like with residual roving or the like thereon from a row of advancing bobbins, said apparatus comprising means for supporting advancing bobbins, means for sensing bobbins supported on said supporting means with residual roving remaining thereon, means responsive to said sensing means for selectively removing sensed bobbins from said supporting means while allowing other bobbins to pass along said supporting means, said bobbin supporting means having an offset section with the initial portion thereof spaced generally one or a multiple bobbin length from said sensing means and disposed to be out of bobbin contact as a bobbin advances into said offset section while being contacted by the trailing end of a bobbin upon lateral movement thereof as it enters said initial portion of said offset section, means in said initial portion of said offset section responsive to a bobbin trailing end in said initial portion of said offset section for temporarily deactivating said sensing means to allow a bobbin leading end to pass said sensing means without activation thereof.

2. An apparatus for selectively removing bobbins or the like according to claim 1 and characterized further in that said sensing means comprises a feeler finger disposed in the path of an advancing bobbin to engage the surface thereof and detect laterial projections thereon such as residual roving, and said deactivating means in said offset section causes said feeler finger to be displaced laterally out of bobbin contact to permit a bobbin leading end to pass without the feeler finger engaging the end face thereof.

3. An apparatus for selectively removing bobbins or the like according to claim 2 and characterized further in that said feeler finger projects into the path of advancing bobbins at an inclination toward bobbins as they advance to said feeler finger, with said finger being forced farther into the bobbin path by engagement of residual yarn on a bobbin with a corresponding displacement of the engaged bobbin until the feed finger movement is sufficient for response by said bobbin removing means.

4. An apparatus for selectively removing bobbins or the like according to claim 2 and characterized further in that said means responsive to a bobbin trailing end includes a movable member disposed for movable engagement by a bobbin trailing end in said initial portion of said offset section, and by a rocker arm connected at one end to said movable member for rocking in response to movement thereof and being connected to said feeler finger to pivot said finger out of the bobbin path upon said rocking.

5. An apparatus for selectively removing bobbins or the like according to claim 1 and characterized further by means for guiding a bobbin trailing end into said initial portion of said offset section.

6. An apparatus for selectively removing bobbins or the like according to claim 5 and characterized further in that said guide means is yieldably mounted transversely opposite said initial portion of said offset section.

7. An apparatus for selectively removing bobbins or the like according to claim 1 and characterized further in that said bobbin supporting means extends under the row of bobbins and said offset section is offset downwardly for downwardly inclined advance of bobbins thereto and dropping of bobbin trailing ends into said initial portion thereof.

8. An apparatus for selectively removing bobbins or the like according to claim 7 and characterized further in that said means responsive to a bobbin trailing end is disposed for receiving thereon and downwardly displacement by a dropping bobbin trailing end.

9. An apparatus for selectively removing bobbins or the like according to claim 8 and characterized further by means above said initial portion of said offset section for guiding a bobbin trailing end thereinto.

10. An apparatus for selectively removing bobbins or the like according to claim 9 and characterized further in that said guiding means is a pivoted and weighted member disposed for weightingly resting on a bobbin advancing therepast.

* * * * *

UNITED STATES PATENT OFFICE

CERTIFICATE OF CORRECTION

Patent No. 4,256,228 Dated March 17, 1981

Inventor(s) Robert E. Terrell

It is certified that error appears in the above-identified patent and that said Letters Patent are hereby corrected as shown below:

Column 5, line 5, delete "bottons" and insert --bottoms--. Column 6, line 21, delete "wherein" and insert therefor --which--. Column 7, line 11, after "96" insert --extend--. Column 7, line 41, delete "to" and insert therefor --so--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*